US005364073A

United States Patent [19]

Sell

[11] Patent Number: 5,364,073

[45] Date of Patent: Nov. 15, 1994

[54] FREE-CHAIN DEVICE FOR A LEVER HOIST

[75] Inventor: Leslie J. Sell, Bothell, Wash.

[73] Assignee: Ingersoll-Rand Company, Woodcliff Lake, N.J.

[21] Appl. No.: 993,579

[22] Filed: Dec. 21, 1992

[51] Int. Cl.[5] ..... B66D 1/14

[52] U.S. Cl. ..... 254/369; 254/352; 254/366

[58] Field of Search ..... 254/352, 353, 347, 350, 254/365, 366, 372, 369; 192/76, 93 A, 94, 43.1

[56] References Cited

U.S. PATENT DOCUMENTS 1,876,954 9/1932 Johnson ..... 254/350 X
4,469,308 9/1984 Nakamura et al. ..... 254/352 X
4,483,519 11/1984 Nakamura ..... 254/353 X
4,512,555 4/1985 Nakamura ..... 254/353 X
4,768,754 9/1988 Nishimura ..... 254/352 X
5,156,377 10/1992 Nishimura ..... 254/352 X

*Primary Examiner*—Katherine Matecki
*Attorney, Agent, or Firm*—Walter C. Vliet

[57] ABSTRACT

A function selector knob for selecting a free-chain function is provided with a selectively positioned bias dog which contacts a brake driving gear threadingly engaged on a pinion shaft, alternatively biasing the gear in a brake engaging or brake release direction as determined by an over center spring disposed between a selector knob and a pinion supported stop.

11 Claims, 4 Drawing Sheets

FREE-CHAIN DEVICE FOR A LEVER HOIST

BACKGROUND OF THE INVENTION

This invention relates generally to lever operated type hoisting devices and more particularly to a device for lever hoists which permits in one selected mode the free-chain release of the hoisting chain to allow rapid deployment of the chain without the need for hand cranking out the chain.

Lever operated type hoists are known in the prior art. One of the prior art devices includes a spring interposed between a driving member which is repeatedly driven by lever and a driven member of a braking assembly for releasing the brake. With this known device the spring force always acts in a direction releasing the brake assembly. Since the spring force always acts in a direction releasing the braking assembly, light loads which are insufficient to load the brake assembly against the spring force cannot be lifted. In addition, when lowering a light load it is possible to obtain an unwanted brake release causing the load to drop with the result that such a light load cannot be lowered in a controlled fashion by the rocking movement of the lever.

Several solutions have been proposed to overcome this problem, however, to date the solutions have required the use of complicated mechanisms involving the use of opposed torsion springs requiring more complex mechanisms to effect the deployment of the chain idling or free-chain device.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a free-chain device for lever hoists including: a change gear provided on a driving member threadingly engaged on a pinion shaft for driving a load sheave winding up thereabout a chain, rope or the like for a load; a hand-operated lever rockable about the driving member; a first driving pawl selectively engageable with the change gear and driven by the operating lever in a winding-up direction for the load, and a braking assembly preventing the change gear from being driven by the load on the load sheave; the device comprising: a stop fixed to an end of the pinion shaft on an opposite side of the braking assembly with respect to the driving member; a manually operable knob disposed for limited rotation about the stop, the stop being provided with a stop dog means engaging the driving member for limiting excessive rotation of the driving member with a desired range relative to the pinion shaft, the manually operable knob being provided with a biasing dog means for selectively effecting rotation of the driving member into a brake clamping direction and oppositely a break releasing direction; and biasing means disposed between the stop and the manually operable knob for alternatively urging rotation of the manually operable knob in a first direction relative to the stop wherein the biasing dog rotates the driving member in the brake clamping direction and a second direction relative to the stop wherein the biasing dog rotates the driving member in the brake releasing direction.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
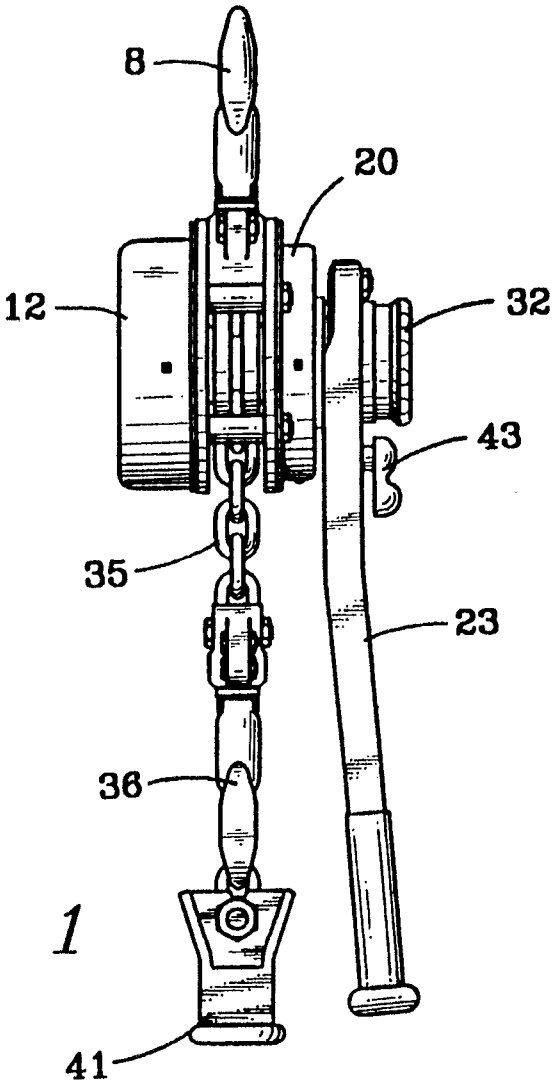
FIG. 1 is a side elevation view of a lever operated hoist according to the present invention.

FIG. 1 shows a hand lever-operated chain hoist according to the present invention. A top hook 8 is utilized to suspend the hoist. The hoist is generally comprised of a body (later described in detail) having a gear cover 12 on one side and a brake cover 20 on the opposite side. A load chain 35 suspends a bottom hook assembly 36. Attached to the opposite end of the load chain 35 is an anchor stop 41 which prevents the chain from feeding through the hoist accidentally. Operation of the hoist is accomplished by cranking the hand lever 23 to raise or lower the load as selected by a function selector lever 43. A manually operable knob 32 is provided to provide both a rapid means of taking up excess chain and as a selector for the free-chain function of the present invention as will be later described.

Figure 2:
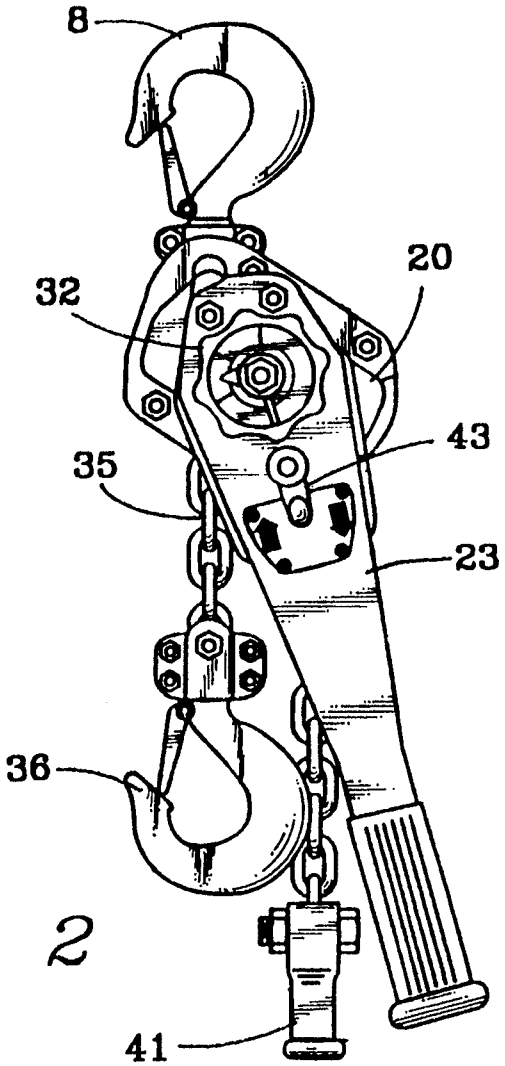
FIG. 2 is a front elevation view of a lever operated hoist according to the present invention.
Figure 4:
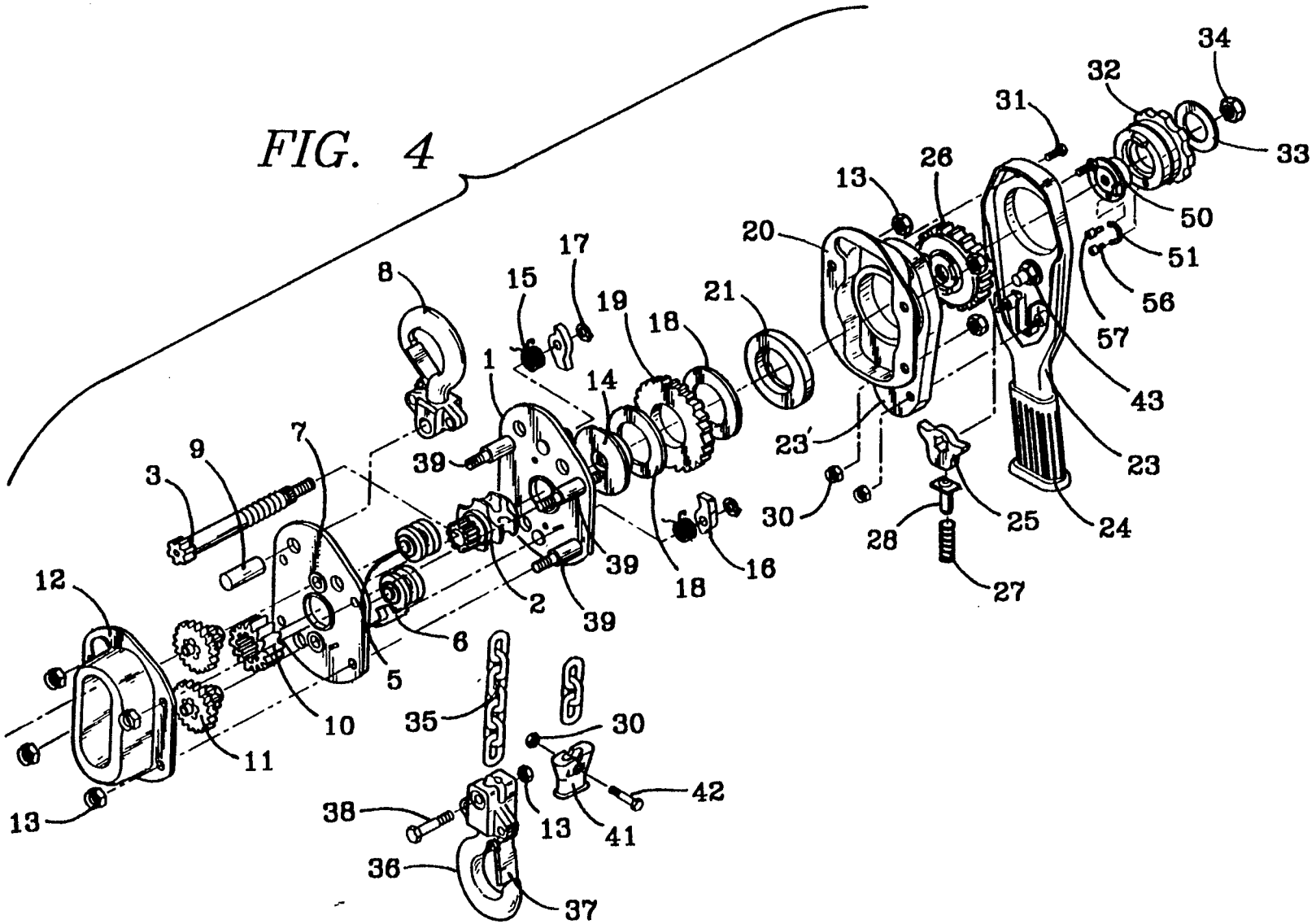
FIG. 4 is an exploded isometric view of a lever operated hoist according to the present invention.

FIG. 2 shows a front view of the lever-operated hoist according to the present invention showing features previously described. FIG. 4 shows an exploded isometric view of a lever-operated hoist according to the present invention. In general, the hoist body is formed by two side plates 1 and 7 which are coupled together by means of four double-ended shoulder bolts 39 and eight nuts 13. A load sheave 2 is disposed between the end plates 1 and 7 for rotation therein in bearing surfaces provided in the end plates 1 and 7. A pinion shaft 3 is disposed within a bore in the load sheave 2 as a rotating counter-shaft having a pinion gear formed on one end and series threaded portions and intermediate splines formed on the other end as will be later described.

The pinion gear formed on the end of the pinion shaft 3 cooperates with reduction gears 10 and 11, which in turn drive the gear formed on the end of the load sheave 2. It should be understood that rotation of the pinion shaft 3 produces a reduced speed with increased force rotation of the load sheave as is well-known in the lever-operated hoist art. The reduction gears are appropriately journaled between the side plate 7 and the gear cover 12.

A pair of load chain guides 5 are provided to insure continued contact of the load chain 35 with the load sheave 2. The load chain guides are mounted on the two lower shoulder bolts 39. A chain stopper 6 cooperates with one of the load chain guides 5 to prevent passage of the chain anchor 41 through the load sheave. This prevents the loss of the load chain and is a safety feature of the hoist. A top hook assembly 8 is mounted to the end plates 1 and 7 by means of a hook pin 9.

Rotation of the pinion shaft 3 is accomplished by means of rocking back and forth a lever 23 which selectively drives a change gear 26 in a selected direction as determined by the orientation of change or ratchet pawl 25. The position of the change pawl 25 is selected by means of rotating the function selector lever 43 (best seen in FIGS. 1 and 2) which in turn rotates the function selector engagement drive 43' which in turn cooperates with the engagement bore formed in the change pawl. The selected position of the change pawl 25 is retained by means of a push-pin 28 and push-spring 27. It should be appreciated that the rocking motion of the hand lever 23 by means of a hand placed on the grip 24 will selectively result in the ratcheting rotation of the change gear 26 in either clockwise or counterclockwise rotation as viewed from the right-hand end. Clockwise rotation will result in the load being raised. Counterclockwise rotation will result in the load being lowered.

The hand lever 23 is assembled to the brake cover assembly 20 which includes a rotatively journaled hand lever support 23'. Bolts 31 are used to assemble the hand lever 23 to the journal assembly 23. The foregoing is generally understood in the lever-operated hoist art and has been provided merely to assist in the understanding of the present invention.

Figure 3:
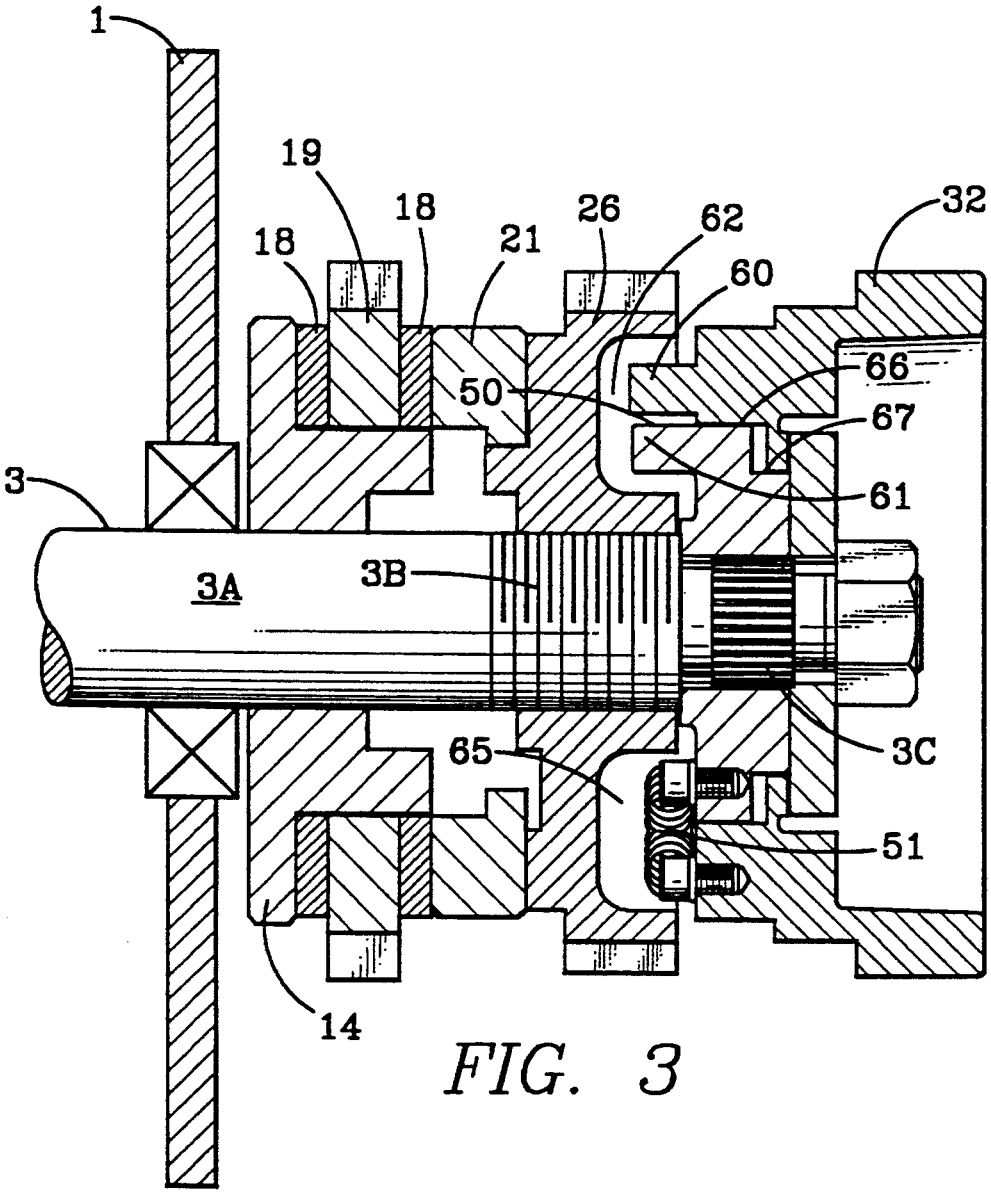
FIG. 3 is a partial cross-section of the brake and free-chain device of a lever operated hoist according to the present invention.

Referring now primarily to FIGS. 3 and 4, a brake and free-chain device, according to the present invention, is shown and generally comprises a hub or back-up flange 14 secured to pinion 3 for rotation. A ratchet gear 19 is disposed for rotation on a shoulder formed on the hub 14. A pair washer-like brake discs 18 are disposed on either side of the ratchet gear 19. A brake ring 21 is utilized to uniformly compress the brake discs 18. It should be appreciated that upon application of pressure to the brake discs the ratchet gear will be secured by friction to rotate with the hub or back-up flange 14.

Brake pawls 16 are mounted for oscillation on to side plate 1 and are spring-loaded by means of springs 15 into engagement with the ratchet gear 19 so as to permit rotation of the ratchet gear 19 only in the clockwise direction as viewed from the right side. The function of the change gear 26 in part was previously described with regard to its ratchet function relationship with the handle or the hand-lever 23. In addition, the change gear provides a means for applying compressive force to the brake ring 21 and thereafter the brake discs 18 to thereby frictionally secure the ratchet gear 19 to the hub or back-up flange 14. This function of the change gear 26 is accomplished by mounting the change gear 26 on a thread **3*b*. As the change gear 26 is rotated clockwise relative to the pinion shaft as viewed from the right, it will advance to the left as shown in FIG. 3, thereby providing the compressive force on the brake ring 21. Conversely, rotation of the change gear in the counterclockwise direction relative to the pinion 3** will unclamp or release the brake.

In the normal windup operation, the ratcheting action of the hand-lever drives the change gear 26 in the clockwise direction and thereafter the pinion through the brake clamping function previously described. This results in lifting the load on the hoist chain 35. It should also be understood at this point that the suspended load will in turn tend to drive the pinion shaft 3 in a counterclockwise direction thereby also applying a braking compression force on the brake ring 21. Since the ratchet gear 19 is prevented from rotating in the counterclockwise direction when it is clamped by the brake, it also prevents rotation of the hub 14 and thence the pinion shaft 3. The small restraining force produced by the change pawl 25 is sufficient to retain the braking action produced by the change gear 26. Thus, the load cannot be lowered until the change gear 26 is physically driven in the counterclockwise direction to release the brake thereby permitting lowering of the load. It should also be appreciated that as the load is released and lowered it will again establish the brake clamping force as previously described and the load will stop when the hand-lever ceases to drive the change gear 26 in the counterclockwise direction. This function is also well-known in the prior art.

It has been found useful, however, to provide a function wherein the change gear may be positioned to eliminate the frictional contact between the brake ring 21 and the change gear 26 thereby permitting a free-rotation of the load sheave 2 to permit rapid deployment of the chain under no-load condition. During this operation it should be understood that it is necessary to provide a small amount of counterclockwise rotation to the change gear 26 relative to the pinion 3 and to retain that displacement against the ratcheting action of the change pawl 25. In the prior art this was accomplished by placing a light compression spring between the hub 14 and the change gear 26. This worked reasonably well where heavy loads were lifted. However, in the case of light loads the spring would prevent the application of the brake in the reverse driven direction, thereby permitting lighter loads to run free even when a controlled ratchet driven descend was desired.

In an effort to cure this undesirable result a number of more complicated devices have been proposed including, for example, opposed torsion springs whose application is controlled by complex axial dislocation and rotation of the manual operating knob. According to the present invention the free-chain function is accomplished by a much simpler mechanism as will now be described.

Figure 5:
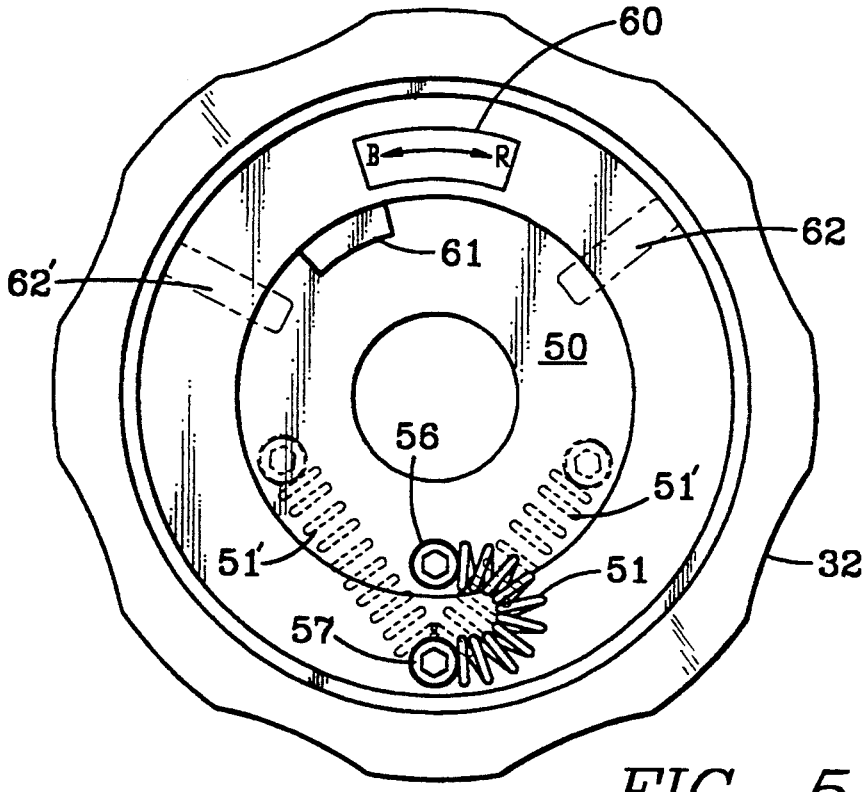
FIG. 5 is a back elevation view of a manually operated knob for the free-chain device according to the present invention.

Referring to FIGS. 3 and 5, according to the present invention a stop 50 is mounted on the pinion 3 by means of a spline **3*c* which prevents rotation of the stop relative to the pinion 3. The stop 50 is provided with a stop dog 61 which projects into a segmented recess 65 formed in the change gear 26. The stop dog operates to intercept a web 62, 62' at each end of the upper segment shown in FIG. 5. The segment length is chosen to restrict the amount of rotation of the manual knob 32. In the brake releasing direction, the stop dog 61** functions as a limit stop to prevent excessive counterclockwise rotation of the change gear.

The manual operable knob 32 is journaled for rotation about the stop 50 on the circumferential lands 66 and 67 as best seen in FIG. 3. It should be thus understood that the manual operable knob 32 is free to rotate about the stop 50. The manual operable knob 32 is further provided with a biasing dog 60 which also intercepts the circumferential segmented recess 65 and, when deployed as will be later described, either contacts the web 62 to release the brake or web 62' to bias the brake in the clamping direction. Deployment of the biasing dog 60 is best understood by referring to FIG. 5. As previously stated the stop 50 is splined to the pinion 3 and the manually operated knob or free knob 32 is free to rotate about the stop 50. The relative rotation between the stop 50 and the knob 32 is effected by a spring-biasing means 51. The biasing means provided is formed from a straight coil wound spring which is rotatably attached to the stop 50 by means of a cap screw 56 and to the knob 32 by means of a cap screw 57.

The spring 51 is normally a straight spring which positions the knob 32 relative to the stop 50. For example, the knob 32 is positioned relatively counterclockwise, as shown in FIG. 5, when the spring is in the position shown in phantom lines by the reference numeral 51' and knob 32 is positioned relatively clockwise when the spring is in the position shown by the phantom lines by reference numeral 52''. The intermediate position is represented by the spring shown bent in a U shape form, by the reference numeral 51, as it transfers from one position to the other.

It should be understood that FIG. 5 is viewed from the under side or left side of the knob 32. Hence, the actual positioning function is opposite (rotation wise) when viewed from the right-hand end for the functions previously described relative the change gear 26. Thus, when the spring is in the position 51', the biasing dog 60 is displaced to the left where it contacts web 62' to produce a brake-clamping bias on the change gear, i.e., clockwise rotation when viewed from the right-hand side. Conversely, when the spring is in the position shown by the reference numeral 51'' the biasing dog 60 is displaced to the right to engage web 62 in the brake releasing direction of the change gear 26.

Figure 6:
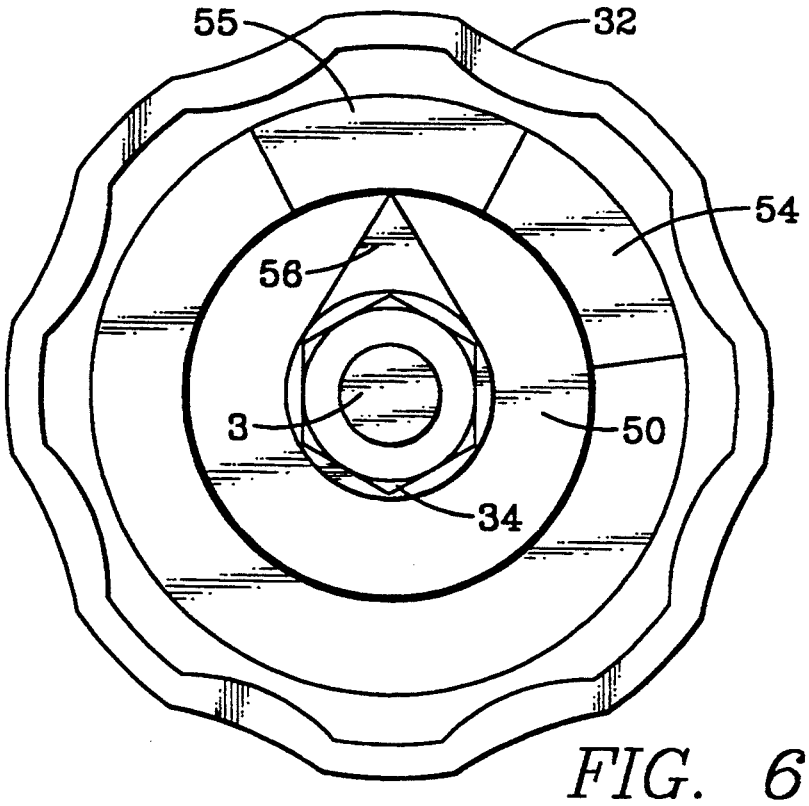
FIG. 6 is a front elevation view of a manually operated knob for a free-chain device according to the present invention.

Referring to FIG. 6 the relative position of the pinion 3 with regard to the knob 32 may be shown by an indicator attached to the pinion 3. Colored segments 54,55 may be utilized to indicate the function. For example, a green segment 55 is utilized to indicate the brake applied normal function, and a red segment 54 as indicating the free-chain condition. It should be appreciated that the function is readily selected by turning the knob 32 in the appropriate direction to make the selection and that the function is now accomplished by a simple and reliable single biasing spring. A coil spring 51 has been found to work particularly well, however, a formed bent spring or the like may also be substituted with reasonable function.

What is claimed is:

1. A free chain device for a lever operated hoist including:

a change gear threadingly engaged on a pinion shaft for driving a load sheave winding up thereabout a chain, rope, or the like for a load, a hand operated lever rockable about said change gear, a first driving pawl selectively engageable with said change gear and driven by said operating lever in a winding-up direction for load, and a braking assembly preventing said change gear from being driven by said load on said load sheave, said device comprising:

a stop fixed to an end of said pinion shaft on an opposite side of said braking assembly with respect to said change gear, a manually operable knob disposed for limited rotation about said stop, said stop being provided with a stop dog means engaging said driving member for limiting excessive rotation of said driving member within a desired range relative to said pinion shaft, said manually operable knob being provided with a biasing dog means for selectively effecting rotation of said driving member into a brake clamping direction and oppositely a brake releasing direction;

biasing means disposed between said stop and said manually operable knob for alternatively urging rotation of said manually operable knob in a first direction relative to said stop wherein said biasing dog means rotates said sheaving member in said brake clamping direction and a second direction relative to said stop wherein said biasing dog means rotates said driving member in said brake releasing direction; and wherein said manually operable knob rotates about said stop in an axial restrained groove formed on said stop and said biasing means disposed between said stop and said manually operable knob further comprises an over center spring device for effecting and retaining relative position and biasing between said stop and said manually operable knob.

2. A free chain device for a lever operated hoist according to claim 1, wherein said stop dog engages said change gear at spaced apart limit stops formed on said change gear.

3. A free chain device for a lever operated hoist according to claim 2, wherein said spaced apart limits stops are formed by a segmented recess formed in a face of said change gear facing said stop.

4. A free chain device for a lever operated hoist according to claim 1, wherein said biasing dog means engages said change gear at spaced apart limit stops formed on said change gear.

5. A free chain device for a lever operated hoist according to claim 4, wherein said spaced apart limit stops are formed by a segmented recess formed in a face of said change gear facing said stop.

6. A free-chain device for a lever operated hoist according to claim 5, wherein said segmented recess is a semi-circular segmented recess.

7. A free-chain device for a lever operated hoist according to claim 1, wherein said stop dog and said biasing dog means are disposed within a same segmented limit stop for selectively engaging one end or another end of said limit stop for selectively biasing said change gear and effecting rotation thereof into a first said brake clamping direction and alternatively a second said brake releasing direction.

8. A free-chain device for a lever operated hoist according to claim 1, wherein said over center spring device is a bendable straight spring secured at opposite ends to said stop and said manually operable knob.

9. A free-chain device for a lever operated hoist according to claim 8, wherein said stop and said manually operable knob are each provided with a coplaner face portion in relative rotation and said spring is disposed on said coplaner face of each.

10. A free-chain device for a lever operated hoist according to claim 1, wherein the relative rotation of said stop and said manually operable knob are manually set and said biasing means thereafter biases the relative rotation in the opposite direction to the manually set direction of rotation.

11. A free-chain device for a lever operated hoist according to claim 10, wherein said biasing dog means engages said change gear in a segmented recess formed on said change gear.

* * * * *